US005678591A

United States Patent [19]

Merrifield et al.

[11] Patent Number: 5,678,591

[45] Date of Patent: Oct. 21, 1997

[54] TWO-COMPONENTS PRESSURE FEED SYSTEM

[75] Inventors: Philip John Merrifield; Bernard Michael Daley, both of Dorset, United Kingdom

[73] Assignee: ITW Limited, United Kingdom

[21] Appl. No.: 650,432

[22] Filed: May 20, 1996

[30] Foreign Application Priority Data

Jun. 12, 1995 [GB] United Kingdom ..... 9511872

[51] Int. Cl.[6] ..... F04F 1/06

[52] U.S. Cl. ..... 137/208; 137/209; 137/264; 239/306

[58] Field of Search ..... 137/208, 209, 137/264; 239/304, 306

[56] References Cited

U.S. PATENT DOCUMENTS

| | | | |
|---|---|---|---|
| 2,813,751 | 11/1957 | Barrett | 239/306 |
| 3,033,472 | 5/1962 | Shelton | 239/306 X |
| 4,565,511 | 1/1986 | Ramisch | 137/98 X |
| 5,492,144 | 2/1996 | Kriewaldt | 137/208 X |

FOREIGN PATENT DOCUMENTS

| | | |
|---|---|---|
| 1094080 | 12/1967 | United Kingdom . |
| 1285785 | 1/1977 | United Kingdom . |
| 1291901 | 10/1992 | United Kingdom . |
| 2264684 | 8/1993 | United Kingdom . |

*Primary Examiner*—Gerald A. Michalsky
*Attorney, Agent, or Firm*—MacMillan, Sobanski & Todd

[57] ABSTRACT

A multi-component feed system to feed two fluid materials from a feed tank to a spraygun is described. The combined pressure feed tank comprises a pressure feed tank with a lid. Inside the tank is a removable support structure having a cone-shaped member with a central chamber supporting a second container closed by a lid. A splash-proof membrane extends between the inner wall of container and the outer wall of container to protect a second fluid component, e.g. a catalyst from entering the lower chamber of tank. Air is fed to containers and via a regulator, a regulator pipe and through an aperture in the lid. Pressure air feeds the fluid components via tubes to a spray gun, where the components combine to be sprayed.

5 Claims, 1 Drawing Sheet

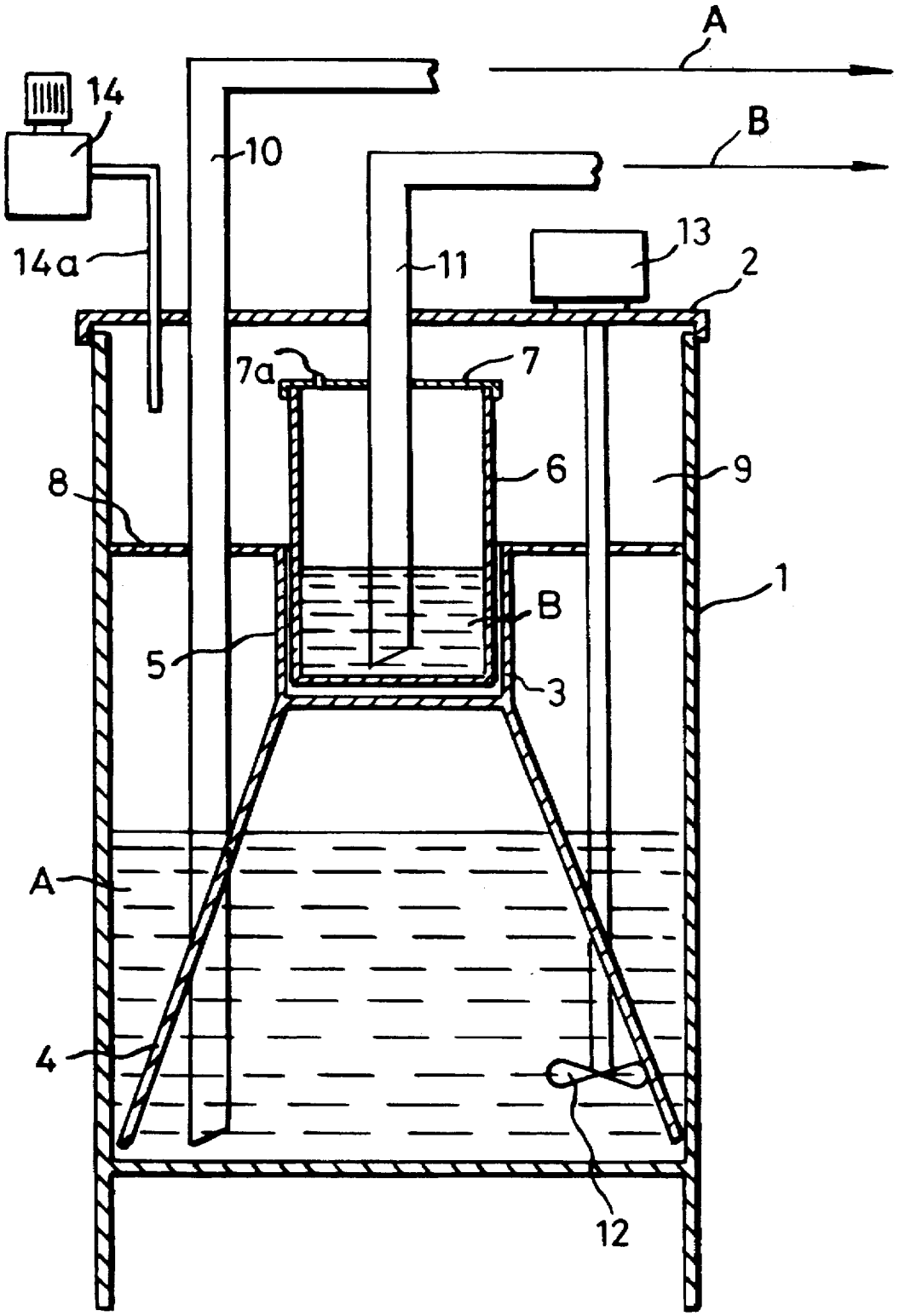
A
B
14
10
14a
11
13
2
7a
7
6
9
8
1
B
5
3
A
4
12

TWO-COMPONENTS PRESSURE FEED SYSTEM

This invention relates to a single pressure feed system to feed a two component fluid material from a feed tank to a srpay gun.

Stainless steel pressure feed tanks are already known to provide a simple and economic means of fluid transfer at regulated pressure to an automatic or manual spray gun. Such tanks are suitable for use with all finishing materials, including waterbased, acid catalysed and halogenated hydrocarbons.

These known tanks can also be used to supply two different component materials for mixing in a spray gun by utilizing two separate tanks which duplicates the space and costs with the resultant disadvantages.

An aim of the present invention is to overcome these disadvantages by providing a single pressure feed system to feed a two component fluid material to a spay gun.

According to the present invention there is provided a multi-component feed system to fed at least two fluid materials from a feed tank divided into a plurality of compartments, means to regulate a single gas supply to the compartments to deliver the fluid materials to a spray gun.

Preferably, a first tank contains one of the pressurised fluid components and a second tank is located in the first tank for a second fluid component, the contents of the two tanks being isolated from one another by a splash proof membrane.

Conveniently, pressurised air is fed to the fist tank via an adjustable air regulator.

In a preferred construction, the fluid component in the first tank is maintained in a consistent fluid state by an agitator assembly driven by an air motor.

Preferably, the second tank is supported within the first tank by a support structure comprising a base supporting an open topped chamber for the second tank.

Conveniently, the second tank is closed by a lid with an aperture for entry of the pressurised air.

An embodiment of the present invention will now be described, by way of example only, with reference to the accompanying drawings which illustrate an axial cross-section through a pressure feed system.

The combined pressure feed tank comprises a main stainless steel pressure feed tank 1 with a lid 2. Inside the tank 1 is a movable stainless steel support structure 3 having a downwardly extending cone shaped member 4 with a central open topped chamber 5 in which is located a second container 6. The second container is drip-free and splash proof closed by a lid 7.

Extending between the inner wall of container 1 and the outer wall of container 6 is a splash-proof membrane 8 to protect a second fluid component 'B', which may be a catalyst from entering the lower chamber 5 of the tank 1. The component 'B' which may be a catalyst for an adhesive component 'A' is carried in the container 6 which is also prevented from entering the tank 1 and thus prevent the components 'A' and 'B' from intermixing with each other until they are fed to a manual or automatic spray gun (not shown).

Air is fed to the two pressurised containers 1 and 6 from a single pressure air source via a regulator 14, a regulator pipe 14*a* in lid 2 and through an aperture 7*a* in the lid 7. The pressured air feeds fluid component 'A' via a tube 10 to a spray gun while fluid component 'B' is fed via a tube 11 to the spray gun where the components combine and are sprayed into the surface of an article (not shown).

Component 'A' is maintained in a fluid state by an agitator assembly with a vaned rotor 12 driven by e.g. an air motor 13. The air regulator 14 is connected to the upper chamber 9 of the container 1 to regulator the air pressure in the containers.

In operation of the pressure feed system, air pressure is applied to the pressure feed tank 1 via the adjustable air regulator 14. The air is passed into the tank via a one way check value to ensure that fluid component 'A' cannot migrate into the air regulator. The air pressure inside the tank 1 displaces the fluid component 'A' in the tank forcing it along tube 10 to the spray gun. The amount of the fluid component delivered to the spray gun is proportional to the amount of air pressure applied to the system. Thus, increasing or decreasing the air pressure will result in an increase or decrease in the fluid flow.

Because the flow rate is also dependent on the viscosity of the fluid being sprayed, if the two fluid components 'A' and 'B' are of different viscosities it will be necessary to re-regulate component 'B' externally from the pressure feed tank, i.e. with a flow meter.

The two fluid components 'A' and 'B' are kept apart by means of the protective membrane 8 and by the container 6. This is necessary as pre-mixing of the two components would cause the adhesive component 'A' to mix with the catalyst component 'B' and harden inside the tank 1. Mixing takes place in the spray gun or externally thereof.

The improved feed system according to the invention, has the following advantages:

1. There is a reduction in costs compared with existing separate tank systems;
2. The improved dual tank system is more portable, e.g. mounted on a trolley;
3. Only one air supply is required;
4. The unit requires the minimum of floor space, and makes maximum use of the space in the pressure feed tank.

We claim:

1. A multi-component feed system to feed at least two fluid material components to a spray gun, said system comprising a feed tank divided to hold a plurality of components, means to regulate a single gas supply to pressurize the components to deliver the fluid material components to the spray gun, wherein a first tank is adapted to contain one of the pressurized fluid components, a second tank is located in said first tank for containing a second pressurized fluid component, and the contents of the two tanks are isolated from one another by a splash-proof membrane.

2. A feed system as claimed in claim 1, wherein pressurised air is fed to the first tank via an adjustable air regulator.

3. A feed system as claimed in claim 1, and further including an air motor driven agitator assembly adapted to maintain the first component in said first tank in a consistent fluid state.

4. A feed system as claimed in claim 1, wherein said second tank is supported within said first tank by a support structure comprising a base supporting an open topped chamber for said second tank.

5. A feed system as claimed in claim 1, wherein said second tank is closed by a lid with an aperture for entry of said pressurised air.

* * * * *